US012134116B2

(12) United States Patent
Anderson et al.

(10) Patent No.: US 12,134,116 B2
(45) Date of Patent: Nov. 5, 2024

(54) QUICK-CHANGE ROLL COOLING HEADER CARTRIDGE WITH REAL-TIME FEEDBACK OF OPERATIONAL DATA

(71) Applicant: PRIMETALS TECHNOLOGIES USA LLC, Alpharetta, GA (US)

(72) Inventors: Matthew C. Anderson, Lancaster, MA (US); Jacob Marshall, Dudley, MA (US)

(73) Assignee: Primetals Technologies USA LLC, Alpharetta, GA (US)

( * ) Notice: Subject to any disclaimer, the term of this patent is extended or adjusted under 35 U.S.C. 154(b) by 109 days.

(21) Appl. No.: 17/983,493

(22) Filed: Nov. 9, 2022

(65) Prior Publication Data

US 2024/0149318 A1 May 9, 2024

(51) Int. Cl.
*B21B 45/02* (2006.01)
*B21B 38/00* (2006.01)

(52) U.S. Cl.
CPC ..... *B21B 45/0233* (2013.01); *B21B 38/00* (2013.01)

(58) Field of Classification Search
CPC ..... B21B 27/10; B21B 2027/103; B21B 2203/30; B21B 45/0233; B21B 45/0245
See application file for complete search history.

(56) References Cited

U.S. PATENT DOCUMENTS

| | | | |
|---|---|---|---|
| 4,418,559 A | 12/1983 | Huzyak | |
| 2015/0020845 A1 | 1/2015 | Dagner et al. | |
| 2023/0405657 A1* | 12/2023 | Gieseler | B21B 45/0233 |

FOREIGN PATENT DOCUMENTS

| | | |
|---|---|---|
| CN | 105598188 A | 5/2016 |
| JP | H04210812 A | 7/1992 |
| JP | H0771688 B2 | 8/1995 |

OTHER PUBLICATIONS

International Search Report and Written Opinion issued Dec. 22, 2023 in related PCT/US2023/035465.

* cited by examiner

*Primary Examiner* — Bobby Yeonjin Kim
(74) *Attorney, Agent, or Firm* — Gesmer Updegrove LLP

(57) ABSTRACT

Disclosed is a novel split header for use in a rolling mill. The split header has a mounting block and a quick-change header cartridge, wherein the mounting block is coupled to the quick-change header via a quick-disconnect feature, the quick-disconnect feature configured to enable uncoupling (in a toolless manner) of the quick-change header from the mounting block. Additionally, the quick-change header cartridge may be replaced by a dummy header cartridge that diverts water when stand is dummied, and a split base and header cartridge design. Further, the mounting block may have one or more sensors and the quick-change header may have an RFID tag, where the sensors and the RFID tag may communicate with a central computer.

25 Claims, 3 Drawing Sheets

QUICK-CHANGE ROLL COOLING HEADER CARTRIDGE WITH REAL-TIME FEEDBACK OF OPERATIONAL DATA

BACKGROUND OF THE INVENTION

Field of Invention

The present invention relates generally to the field of rolling mills. More specifically, the present invention is related to a quick-change roll cooling header cartridge with real-time feedback of operational data.

Discussion of Related Art

Roll cooling headers wear or clog over time and are often overlooked until the wear or clog becomes severe resulting in sub-optimal roll cooling. The disclosed methodology utilizes sensors, RFID tags, and a central computer that track usage, and provide alerts and feedback to the operator as to the condition of the individual header so they can be cleaned or replaced as soon as possible.

The problem described above is currently solved by visual inspection of the cooling headers by the operator.

Embodiments of the present invention are an improvement over prior art systems and methods.

SUMMARY OF THE INVENTION

In one embodiment, the present invention provides a split header for use in a rolling mill, the split header comprising: a mounting block; and a quick-change header cartridge comprising a plurality of spray nozzles, and wherein the mounting block wears at a rate less than the quick-change header cartridge and wherein the mounting block is coupled to the quick-change header via a quick-disconnect feature, the quick-disconnect feature configured to enable uncoupling of the quick-change header from the mounting block.

In another embodiment, the present invention provides a method comprising: (a) removing a quick-change header cartridge from a mounting block in a split header of a rolling mill, wherein the mounting block wears at a rate less than the quick-change header cartridge, and wherein the removing is done via manipulating a quick-disconnect feature, and (b) attaching a dummy header cartridge onto the mounting block in place of the removed quick-change header, wherein the dummy header is configured to divert water away from one or more sealing areas and into a drain.

In yet another embodiment, the present invention provides a method for retrofitting a header in a rolling mill comprising: replacing the header with a split header, the split header comprising a mounting block and a quick-change header cartridge, wherein the mounting block wears at a rate less than the quick-change header cartridge and wherein the mounting block is coupled to the quick-change header via a quick-disconnect feature, the quick-disconnect feature configured to enable uncoupling of the quick-change header from the mounting block.

In another embodiment, the present invention provides a split header for use in a rolling mill, the split header comprising: a mounting block, the mounting block comprising one or more sensors; and a quick-change header cartridge comprising a plurality of spray nozzles and an RFID tag, wherein the mounting block wears at a rate less than the quick-change header cartridge and wherein the mounting block is coupled to the quick-change header via a quick-disconnect feature, the quick-disconnect feature configured to enable uncoupling of the quick-change header from the mounting block, and wherein the one or more sensors and the RFID tag are configured to communicate data with a central computer, wherein the central computer receives the data and provides one or more of the following: alert feedback or warning feedback.

BRIEF DESCRIPTION OF THE DRAWINGS

The present disclosure, in accordance with one or more various examples, is described in detail with reference to the following figures. The drawings are provided for purposes of illustration only and merely depict examples of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

DESCRIPTION OF THE PREFERRED EMBODIMENTS

Figure 1:
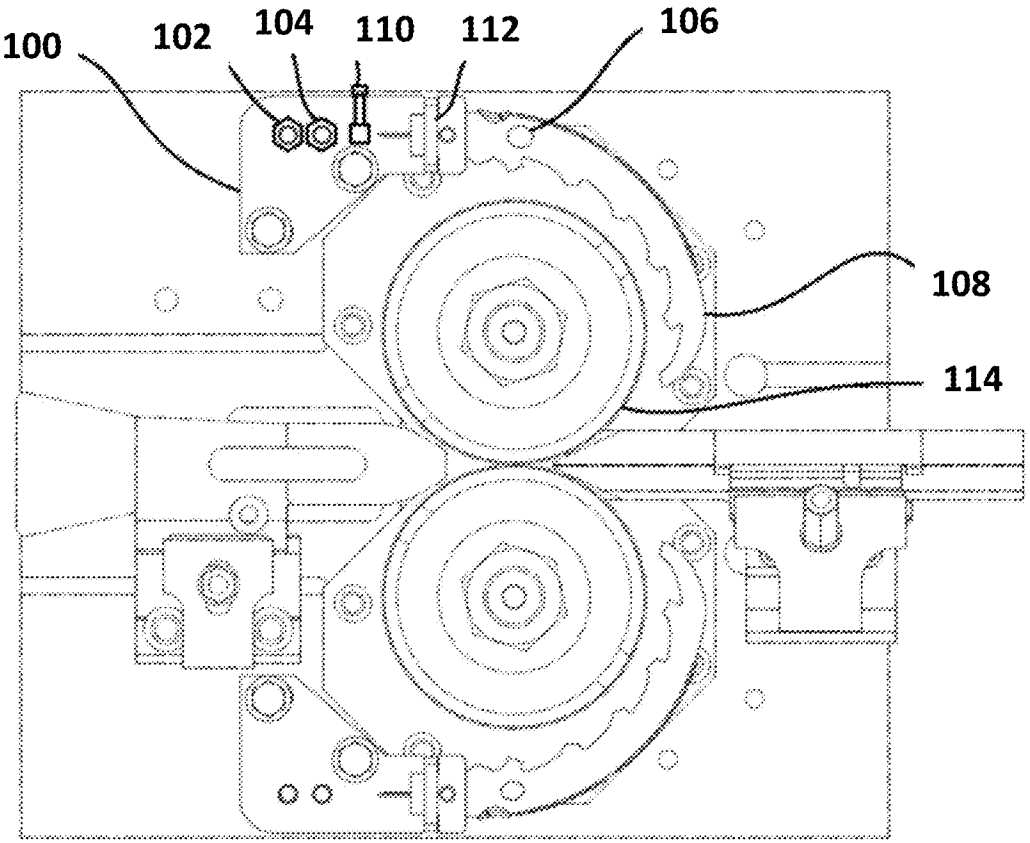
FIG. 1 depicts the split header design of the present invention.

While this invention is illustrated and described in a preferred embodiment, the invention may be produced in many different configurations. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

Note that in this description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, the present invention can include any variety of combinations and/or integrations of the embodiments described herein.

The present invention provides a system comprising one or more sensors, RFID tags, and a central computer that tracks usage and provides alerts/feedback to the operator with respect to the condition of an individual header, so they can be cleaned or replaced as soon as possible.

When roll cooling headers are discarded, it is often due to wear in a localized region around the spray nozzles, while the remainder of the header body is perfectly intact. Scrapping the entire header due to wear in a single region is wasteful from a cost, material, and resources perspective. In one embodiment, the present invention provides a header that is split into two components: a durable, slow wearing, base/mounting block and a minimalist, more rapidly wearing, quick-change header cartridge that contains the spray nozzles.

As noted earlier, when roll cooling headers are worn or clogged, they must be replaced. This process can take a significant amount of time due to the fastening methods utilized. One non-limiting example of such a fastening method is to use several screws or bolts to secure the header directly to the mill stand (or to a mounting bracket that positions the header). The present invention provides a method for a quick change/disconnect feature to the header cartridge that allows for a quick toolless changeover.

The piping that feeds roll cooling headers can be different lengths and have different paths and levels of restriction. These differences may cause individual headers to be supplied with different pressures and flows, resulting in uneven cooling and wear across the different mill rolls. The present invention utilizes sensors, valves, and operator feedback to balance out such imbalances in the system and provide uniform cooling across mill rolls.

Cooling headers are often designed to have differing designs for the top and bottom roll of a particular rolling stand and across different rolling stands. Such designs require one to inventory two different part numbers for each stand, and potentially many part numbers when considering multiple stands. The present invention utilizes a non-handed header cartridge that can be used in both the upper and lower positions and across different stands, so that far fewer part numbers are required to be inventoried.

During usual practice, when a mill stand is not being used during a particular rolling campaign, the roll cooling headers remain in place and continue to spray water because the headers cannot readily be individually turned off. This situation is more likely to cause water ingress into the lubrication system of the rolling mill due to the inability to seal as well in this condition. The present invention provides for 'dummy' header cartridges that can be quickly swapped into place to divert the water away from the sealing areas and safely into the drain.

Figure 2:
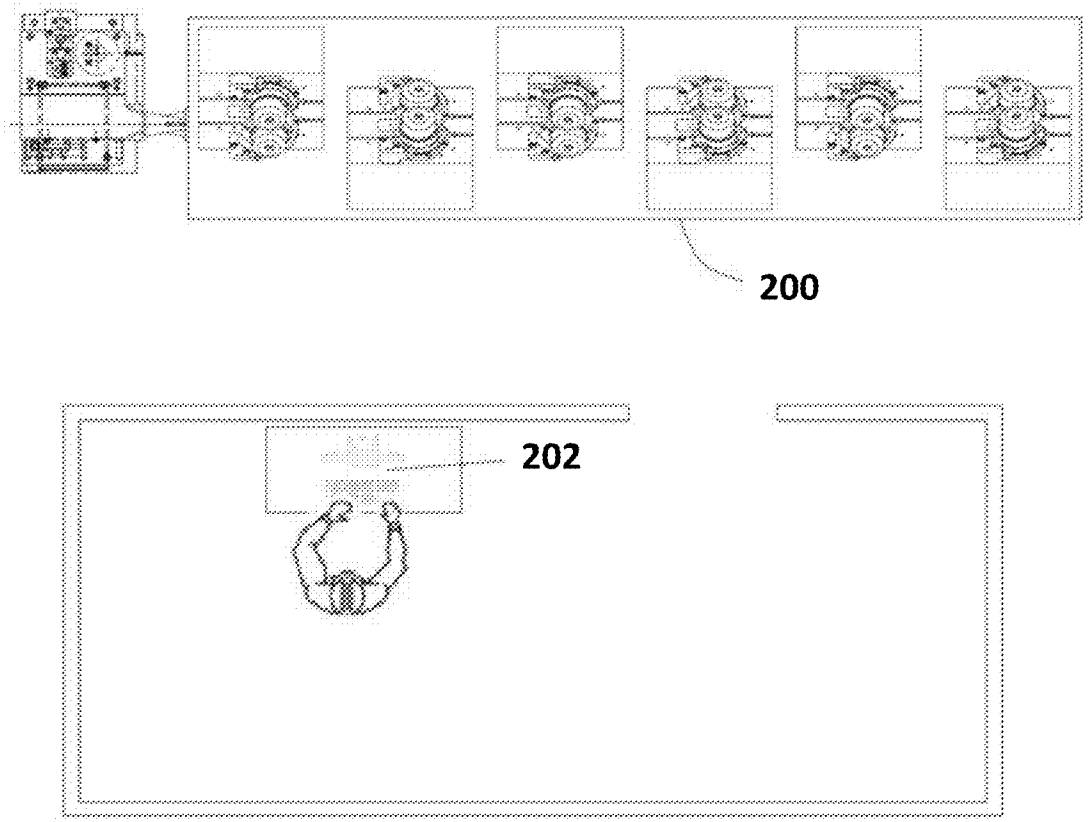
FIG. 2 depicts a central computer that receives data from one or more sensors and/or RFID tags disposed on the split header.

FIG. 1 depicts a plurality of sensors that are embedded into the mounting block 100 and an RFID tag 106 that is embedded in the header cartridge 108. Header refers to the traditional style where everything is all one piece, whereas a header cartridge is the quick changing portion of the cartridge/mounting block design that replaces the traditional header design. FIGS. 1 and 2 both show the header cartridge/mounting block design. In one non-limiting example, two potential mounting block sensors include a temperature sensor 102 and a pressure sensor 104. Examples of other sensors include, but are not limited to, the following: flow sensor, proximity sensor, microphone, vibration sensor, fluid property sensor, optical sensor, etc. However, the number of sensors or the type of sensor should not be used to limit the scope of the present invention, as a plurality of sensors and a plurality of sensor types are envisioned for use as part of the present invention.

It should be noted that while RFID tags are used in one embodiment, other embodiments are envisioned where quick response (QR) codes, bar codes, or serial numbers could be used for tracking individual header cartridge usage instead of RFID tags.

Sensors 102 and 104 (and other sensors (not shown)) communicate data via a wired or wireless connection shown in FIG. 2 from the rolling mill 200 back to a central computer 202. Central computer 202 displays operational data and provides alerts/warning feedback as to the current operational state of the headers. Examples of such alerts could include: clogged header cartridge warning, worn header cartridge nozzle warning, pressure imbalance warning, maintenance warning—to tell the operator when to change out the cartridges based on time in operation, low or high system pressure warning, low or high water temperature warning, header cartridge not in position warning, operational information feedback, cartridge in position feedback, cooling water property feedback, etc. Such feedback allows the operators to replace worn, missing, or clogged headers in a timely manner as well as balance out the system by manually or automatically adjusting valves 110 in FIG. 1, to adjust the flow of water to each header 108, etc.

The RFID tag 106 allows tracking of time or tonnage in the mill during the operation of each header cartridge. The sensors allow the control system to recognize when the water-cooling system is in operation, this allows tracking of usage of header cartridges to be done. Also, the RFID tags could be incorporated to track specific header cartridges. The operator would scan the RFID tag of a particular header when it is put in operation and when it is taken out of operation.

In FIG. 1, the present invention provides a design where the header design is split into two units: a mounting block 100 and header cartridge 108. The mounting block 100 is of durable, long-lasting design, and the minimalist cooling header 108 is held in place by a toolless 'quick-disconnect' feature 112. The term "minimalist" used in the current context means using as little material as necessary (i.e., making the header as cheap as possible, without affecting performance), thereby wasting less material and minimizing cost. In FIG. 1, the quick disconnect is a U-shaped clip that is secured in place with a cotter pin or spring clip that prevents the header cartridge from rotating or being removed when in place. In another embodiment, the quick-disconnect is a clamp that can be released by hand. In yet another embodiment, the quick-disconnect is a threaded retaining ring that can be threaded or unthreaded by hand. In another embodiment, the quick-disconnect is a spring-loaded clip that can be depressed by hand. However, it should be noted that any element that holds the cartridge securely in place during operation but may be easily removed by the operator (with or preferably without the use of any other tools) may be used as a quick disconnect element. The cooling header 108 continuously sprays water onto the mill roll 114 during rolling. The cartridge design is sealed to the mounting block with an O-ring or other sealing mechanism. This split design also solves the issue of handed headers, which in the disclosed methodology are un-handed.

Figure 3:
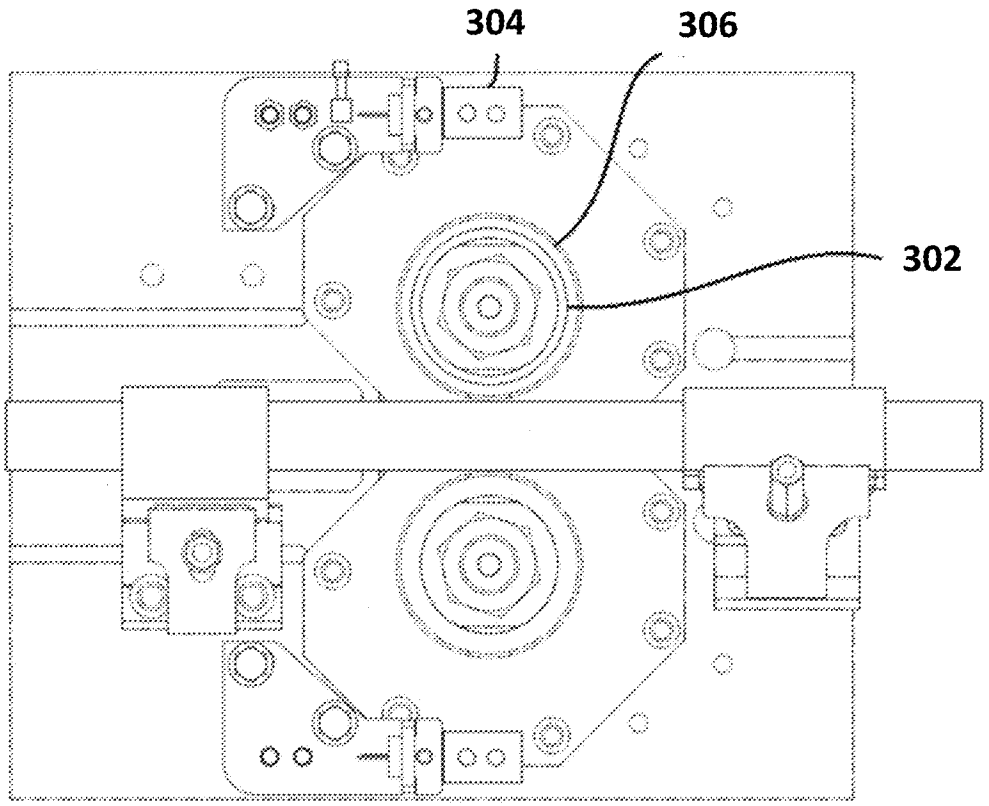
FIG. 3 depicts the present invention's dummy headers.

FIG. 3 depicts the present invention's dummy headers. It should be noted that the mill rolls are not in place in this configuration, and replaced by dummy covers 302. The dummy header cartridge 304, diverts the water away from the sealing area 306. The "dummy header cartridge" refers to a replacement for the regular header cartridge when the mill stand is not being used while other surrounding stands are still being used. In this configuration, there are no rolls to be cooled, however, the water cannot be individually turned off. With the existing design, the headers stay in place and continue to spray water where the rolls normally would be, and this area has seals to the inside of the equipment, which can end up leaking water into the oil system. The dummy header cartridge would be swapped in place when the stand is dummied, and the water would be diverted away from the sealing area. In one embodiment, the dummy header cartridge would be made with the same materials as the header cartridge and would utilize the same quick disconnect feature.

A major advantage of this system is improved mill roll cooling consistency, which in turn results in longer life of the mill roll, saving money for the operator. Additional advantages include faster cooling header changeover time, less waste due to separate header cartridge and base design, reduced part numbers required for inventory, easy tracking of header cartridge usage, and less water ingress into the rolling mill lubrication system.

Embedded sensors that transmit operational data to a central computer, RFID tags embedded in the header cartridges, quick change toolless header cartridge design, non-handed design of header cartridge, dummy header cartridge that diverts water when stand is dummied, and a split base and header cartridge design.

It should be noted that existing mills may be retrofitted with the split-header design, and would, therefore, provide such existing mills with all the advantages of the present invention.

It should be noted that the sensors could be located elsewhere in the water system (i.e., they do not have to be directly mounted on the mounting block). Such a configuration would make the sensors and wires less susceptible to damage during the rolling process and make routing the wires simpler. Such a configuration could also provide different information about the system's operation. It is possible that a combination of sensors mounted directly to the mounting block and elsewhere in the system could be used. Different split points could be used to optimize the area of the header that wears rapidly; for example, when the first and second nozzles do not wear as fast as the remaining nozzles, one could change the split point to include the first two nozzles in the mounting block and have the remainder in the header cartridge. Conversely, when the mounting block wears too rapidly in one area, one may add this area of rapid wear into the header cartridge. In the figures, the mounting block is bolted to the mill stand, in other configurations it may be part of or bolted to a mounting bracket of some kind.

The above-described features associated with the central computer 202 of FIG. 2 can be implemented as software processes that are specified as a set of instructions recorded on a computer-readable storage medium (also referred to as computer-readable medium). When these instructions are executed by one or more processing unit(s) (e.g., one or more processors, cores of processors, or other processing units), they cause the processing unit(s) to perform the actions indicated in the instructions. Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor. By way of example, and not limitation, such non-transitory computer-readable media can include flash memory, RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. The computer-readable media does not include carrier waves and electronic signals passing wirelessly or over wired connections.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing or executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device.

In this specification, the term "software" is meant to include firmware residing in read-only memory or applications stored in magnetic storage or flash storage, for example, a solid-state drive, which can be read into memory for processing by a processor. Also, in some implementations, multiple software technologies can be implemented as sub-parts of a larger program while remaining distinct software technologies. In some implementations, multiple software technologies can also be implemented as separate programs. Finally, any combination of separate programs that together implement a software technology described here is within the scope of the subject technology. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, for example microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, for example is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, for example application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

It is understood that any specific order or hierarchy of steps in the processes disclosed is an illustration of example approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components illustrated above should not be understood as requiring such separation, and it should be understood that the described program components and systems can generally be integrated together in a single software product or packaged into multiple software products.

Various modifications to these aspects will be readily apparent, and the generic principles defined herein may be applied to other aspects. Thus, the claims are not intended to be limited to the aspects shown herein, but is to be accorded the full scope consistent with the language claims, where reference to an element in the singular is not intended to mean "one and only one" unless specifically so stated, but rather "one or more."

A phrase, for example, an "aspect" does not imply that the aspect is essential to the subject technology or that the aspect applies to all configurations of the subject technology. A disclosure relating to an aspect may apply to all configurations, or one or more configurations. A phrase, for example, an aspect may refer to one or more aspects and vice versa. A phrase, for example, a "configuration" does not imply that such configuration is essential to the subject technology or that such configuration applies to all configurations of the subject technology. A disclosure relating to a configuration may apply to all configurations, or one or more configurations. A phrase, for example, a configuration may refer to one or more configurations and vice versa.

The various embodiments described above are provided by way of illustration only and should not be construed to limit the scope of the disclosure. Those skilled in the art will readily recognize various modifications and changes that may be made to the principles described herein without following the example embodiments and applications illustrated and described herein, and without departing from the spirit and scope of the disclosure.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

As noted above, particular embodiments of the subject matter have been described, but other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

CONCLUSION

A system and method have been shown in the above embodiments for the effective implementation of a quick change roll cooling header cartridge with real-time feedback of operational data. While various preferred embodiments have been shown and described, it will be understood that there is no intent to limit the invention by such disclosure, but rather, it is intended to cover all modifications falling within the spirit and scope of the invention, as defined in the appended claims.

The invention claimed is:

1. A split header for use in a rolling mill, the split header comprising:

a mounting block; and a quick-change header cartridge comprising a plurality of spray nozzles, and wherein the mounting block wears at a rate less than the quick-change header cartridge and wherein the mounting block is coupled to the quick-change header via a quick-disconnect feature, the quick-disconnect feature configured to enable uncoupling of the quick-change header from the mounting block.

2. The split header of claim 1, wherein the mounting block further comprises one or more sensors.

3. The split header of claim 2, wherein the one or more sensors are picked from any of the following: a temperature sensor, a pressure sensor a flow sensor, a proximity sensor, a microphone, a vibration sensor, a fluid property sensor, and an optical sensor.

4. The split header of claim 3, wherein feedback is received to operate a valve on the mounting block to balance out imbalances in pressure in order to provide uniform cooling across mill rolls.

5. The split header of claim 1, wherein the quick-change header further comprises an RFID tag.

6. The split header of claim 5, wherein the RFID tag is configured to track time/tonnage of the rolling mill.

7. The split header of claim 1, wherein the quick-change header further comprises at least one of the following disposed thereon: a Quick Response (QR) code and a bar code.

8. The split header of claim 1, wherein the mounting block further comprises one or more sensors and the quick-change header further comprises an RFID tag, wherein the one or more sensors and the RFID tag are configured to communicate data to a central computer, wherein the central computer receives the data and provides one or more of the following: alert feedback or warning feedback.

9. The split header of claim 8, wherein the alert feedback or warning feedback are associated with any of, or a combination of, the following: a clogged header cartridge warning, a worn header cartridge nozzle warning, a pressure imbalance warning, a maintenance warning, a low or high system pressure warning, a low or high water temperature warning, a header cartridge not in position warning, operational information feedback, a cartridge in position feedback, or cooling water property feedback.

10. A method comprising:

(a) removing a quick-change header cartridge from a mounting block in a split header of a rolling mill, wherein the mounting block wears at a rate less than the quick-change header cartridge, and wherein the removing is done via manipulating a quick-disconnect feature, and (b) attaching a dummy header cartridge onto the mounting block in place of the removed quick-change header, wherein the dummy header is configured to divert water away from one or more sealing areas and into a drain.

11. A method for retrofitting a header in a rolling mill comprising:

replacing the header with a split header, the split header comprising a mounting block and a quick-change header cartridge, wherein the mounting block wears at a rate less than the quick-change header cartridge and wherein the mounting block is coupled to the quick-change header via a quick-disconnect feature, the quick-disconnect feature configured to enable uncoupling of the quick-change header from the mounting block.

12. The method of claim 11, wherein the mounting block further comprises one or more sensors.

13. The method of claim 12, wherein the one or more sensors are picked from any of the following: a temperature sensor, a pressure sensor, a flow sensor, a proximity sensor, a microphone, a vibration sensor, a fluid property sensor, and an optical sensor.

14. The method of claim 13, wherein feedback is received to operate a valve on the mounting block to balance out imbalances in pressure in order to provide uniform cooling across mill rolls.

15. The method of claim 11, wherein the quick-change header further comprises an RFID tag.

16. The method of claim 15, wherein the RFID tag is configured to track time/tonnage of the rolling mill.

17. The method of claim 11, wherein the quick-change header further comprises at least one of the following disposed thereon: a Quick Response (QR) code and a bar code.

18. The method of claim 11, wherein the mounting block further comprises one or more sensors and the quick-change header further comprises an RFID tag, wherein the one or more sensors and the RFID tag are configured to communicate data to a central computer, wherein the central computer receives the data and provides one or more of the following: alert feedback or warning feedback.

19. The method of claim 18, wherein the alert feedback or warning feedback are associated with any of, or a combination of, the following: a clogged header cartridge warning, a worn header cartridge nozzle warning, a pressure imbalance warning, a maintenance warning, a low or high system pressure warning, a low or high water temperature warning, a header cartridge not in position warning, operational information feedback, a cartridge in position feedback, or cooling water property feedback.

20. A split header for use in a rolling mill, the split header comprising:

a mounting block, the mounting block comprising one or more sensors; and a quick-change header cartridge comprising a plurality of spray nozzles and an RFID tag, wherein the mounting block wears at a rate less than the quick-change header cartridge and wherein the mounting block is coupled to the quick-change header via a quick-disconnect feature, the quick-disconnect feature configured to enable uncoupling of the quick-change header from the mounting block, and wherein the one or more sensors and the RFID tag are configured to communicate data with a central computer, wherein the central computer receives the data and provides one or more of the following: alert feedback or warning feedback.

21. The split header of claim 20, wherein the one or more sensors are picked from any of the following: a temperature sensor, a pressure sensor, a flow sensor, a proximity sensor, a microphone, a vibration sensor, a fluid property sensor, and an optical sensor.

22. The split header of claim 20, wherein the RFID tag is configured to track time/tonnage of the rolling mill.

23. The split header of claim 20, wherein feedback is received to operate a valve on the mounting block to balance out imbalances in pressure in order to provide uniform cooling across mill rolls.

24. The split header of claim 20, wherein the mounting block further comprises one or more sensors and the quick-change header further comprises an RFID tag, wherein the one or more sensors and the RFID tag are configured to communicate data to a central computer, wherein the central computer receives the data and provides one or more of the following: alert feedback or warning feedback.

25. The split header of claim 24, wherein the alert feedback or warning feedback are associated with any of, or a combination of, the following: a clogged header cartridge warning, a worn header cartridge nozzle warning, a pressure imbalance warning, a maintenance warning, a low or high system pressure warning, a low or high water temperature warning, a header cartridge not in position warning, operational information feedback, a cartridge in position feedback, or cooling water property feedback.

* * * * *